US006647674B1

(12) United States Patent
Lancelot, III et al.

(10) Patent No.: US 6,647,674 B1
(45) Date of Patent: Nov. 18, 2003

(54) ERECTION ANCHOR FOR CONCRETE PANEL

(75) Inventors: Harry B. Lancelot, III, Centerville, OH (US); Sidney E. Francies, III, Springboro, OH (US)

(73) Assignee: Dayton Superior Corporation, Dayton, OH (US)

( * ) Notice: Subject to any disclaimer, the term of this patent is extended or adjusted under 35 U.S.C. 154(b) by 0 days.

(21) Appl. No.: 10/141,274

(22) Filed: May 8, 2002

(51) Int. Cl.[7] ..... E02D 11/00; E02D 13/00

(52) U.S. Cl. ..... 52/125.4; 52/125.5; 52/125.7; 52/127.2; 52/698; 52/701; 52/704; 52/707; 294/82.17; 294/82.19; 294/82.23; 294/89

(58) Field of Search ..... 52/125.4, 125.5, 52/125.2, 698, 701, 704, 707, 127.7; 294/89, 82.23, 82.17, 82.19

(56) References Cited

U.S. PATENT DOCUMENTS

| | | | | | |
|---|---|---|---|---|---|
| 3,499,676 | A | * | 3/1970 | Haeussler | 294/90 |
| 3,883,170 | A | * | 5/1975 | Fricker et al. | 294/82.35 |
| 4,000,591 | A | * | 1/1977 | Courtois | 52/689 |
| 4,068,879 | A | | 1/1978 | Torbet et al. | |
| 4,173,367 | A | * | 11/1979 | Haeussler | 294/82.34 |
| 4,173,856 | A | | 11/1979 | Fricker | |
| 4,296,909 | A | | 10/1981 | Haeussler | |
| 4,368,914 | A | * | 1/1983 | Truitt et al. | 294/82.33 |
| 4,386,486 | A | | 6/1983 | Holt et al. | |
| 4,437,276 | A | * | 3/1984 | Goldberg | 52/125.5 |
| 4,437,642 | A | | 3/1984 | Holt | |
| 4,580,378 | A | | 4/1986 | Kelly et al. | |
| 4,627,198 | A | * | 12/1986 | Francies, III | 52/125.5 |
| 4,634,164 | A | * | 1/1987 | Fricker | 294/89 |
| 4,671,554 | A | * | 6/1987 | Lancelot | 294/89 |
| 4,702,045 | A | | 10/1987 | Fricker | |
| 4,726,562 | A | * | 2/1988 | Courtois et al. | 249/91 |
| 4,769,960 | A | * | 9/1988 | Zipf et al. | 52/125.4 |
| 5,155,954 | A | * | 10/1992 | Roire | 52/125.5 |
| 5,177,928 | A | * | 1/1993 | Fricker | 52/707 |
| D362,177 | S | * | 9/1995 | Brown, Jr. | D8/384 |
| 5,469,675 | A | * | 11/1995 | Arteon | 52/125.5 |
| 5,596,846 | A | | 1/1997 | Kelly | |
| D392,752 | S | * | 3/1998 | Kelly et al. | D25/133 |
| 5,829,207 | A | | 11/1998 | Mackay Sim et al. | |
| 5,857,296 | A | * | 1/1999 | Niday et al. | 52/125.1 |
| 6,095,483 | A | * | 8/2000 | Mackay Sim et al. | 249/175 |
| 6,152,509 | A | * | 11/2000 | Hansort | 294/89 |
| D436,674 | S | | 1/2001 | Lancelot, III et al. | |
| D438,991 | S | | 3/2001 | Lancelot, III et al. | |
| 6,233,883 | B1 | * | 5/2001 | Arteon | 52/125.4 |
| 6,260,900 | B1 | | 7/2001 | Scott | |
| 6,341,452 | B1 | * | 1/2002 | Bollinghaus | 52/125.5 |

* cited by examiner

*Primary Examiner*—Carl D. Friedman
*Assistant Examiner*—Christy Green
(74) *Attorney, Agent, or Firm*—Wood, Herron & Evans, L.L.P.

(57) ABSTRACT

An erection anchor having a forged unitary body that includes a substantially cylindrical shank with one end embedable in a concrete panel and an opposite end extending into a recess in an end of the concrete panel. The forged unitary body also has a substantially cylindrical foot integrally formed with the one end of the shank and a shackle-engageable, planar head integrally formed with the opposite end of the shank. The planar head has first and second opposed substantially planar surfaces and a boss integrally formed with the planar head and extending outward from the first planar surface. The boss provides bearing surfaces that interlock the erection anchor with the concrete panel.

19 Claims, 2 Drawing Sheets

ERECTION ANCHOR FOR CONCRETE PANEL

FIELD OF THE INVENTION

This invention relates generally to anchors for lifting heavy loads and more particularly, to erection anchors of solid material that are embedded in a precast concrete member for both tension and shear load conditions.

BACKGROUND OF THE INVENTION

The present invention relates to an erection anchor for lifting a concrete panel or structure by its edge, for example, in tilting a precast wall panel. Such a panel is often formed by pouring concrete into a form at floor level, either at, or remote from, a construction site. After the concrete has set or hardened, the horizontal panel is tilted or pivoted on one edge at one end by lifting an opposite end until the panel becomes vertical. Thereafter, the panel is positioned and can serve as a wall of a concrete building. The invention is, however, not limited to panel tilt-up operations. The system may be employed without modification in the lifting of a panel for transport or other purposes.

Heretofore, in the production of precast concrete members or panels that are to be handled by an edge-lifting operation, it is the practice to embed anchors of steel or iron in the precast concrete member. When lifting operations commence, the partially embedded anchor imposes substantial shear forces or stress into the concrete panel. To reduce the concentration of shear forces, it is known to attach a shear force resisting member or shear plate to the anchor body. A shear plate may be a length of right angle bar stock or a length of rectangular bar stock that is welded to the body of the erection anchor. With some known erection anchors, a shear plate is attached to only one side of the anchor body. Such an erection anchor must be oriented in the concrete panel such that the shear plate faces the direction of the lift force. In other words, in its horizontal orientation, the concrete panel has major upper and lower surfaces; and the erection anchor must be oriented such that the shear plate is between the erection anchor body and the upper major surface as well as substantially parallel to the upper major surface. Thus, as the concrete panel is lifted, the shear plate spreads the shear forces and permits the concrete panel to better react those forces.

The requirement to properly orient an erection anchor having a single shear plate is a further disadvantage. For example, if the anchor is misoriented by 180° and the shear plate is located between the erection anchor body and the lower major surface of the concrete panel, the shear force resisting capability of the erection anchor may be lessened. Therefore, erection anchors having a welded shear plate impose a significant burden on the user to properly orient each of the erection anchors in a concrete form before the concrete panel is poured. Such a requirement substantially increases the time and cost associated with the manufacture of the concrete panel.

Other known erection anchors have shear plates welded to the anchor body. A disadvantage of known erection anchors with shear plates is that they are fabricated from multiple parts and thus, are expensive. The added cost of welding the shear plates to the anchor body is substantial compared to the cost of manufacturing the basic anchor to which the shear plate is being attached. Thus, the significantly greater manufacturing cost places a premium on the use of such erection anchors.

The head of the erection anchor is located in a recess in an end of the concrete panel. Often, the head is designed to receive a shackle lifting pin. With known erection anchors, the process of connecting the shackle, lifting the concrete panel and disconnecting the shackle, often results in the lifting shackle contacting and sometimes chipping the end of the concrete panel.

Therefore, there is a need for an erection anchor that is less expensive to manufacture, easier to use and less abusive of the end surface of the concrete panel.

SUMMARY OF THE INVENTION

The present invention provides an erection anchor that is more cost effective and does contact the end of the concrete panel with which it is used. The erection anchor of the present invention provides integral force bearing surfaces that help the erection anchor interlock with the concrete panel. Thus, the erection anchor of the present invention is not fabricated from multiple parts and is substantially less expensive to manufacture than known erection anchors. The erection anchor of the present invention has a head that is configured to receive and secure the shackle lifting apparatus so that it cannot contact an end of a concrete panel being lifted.

According to the principles of the present invention and in accordance with the described embodiments, the invention provides an erection anchor for use in a concrete panel having substantially parallel major surfaces and a recess in an end of the concrete panel. The erection anchor has a forged unitary body that includes a substantially cylindrical shank with one end embedable in the end of the concrete panel and an opposite end extendable into the recess in the end of the concrete panel. The forged unitary body also has a substantially cylindrical foot integrally formed with the one end of the shank with a diameter greater than a diameter of the cylindrical shaft. The forged unitary body is completed by a shackle-engageable, planar head integrally formed with the opposite end of the shank and disposable in the recess in the end of the concrete panel. The planar head has first and second opposed substantially planar surfaces and a boss integrally formed with the planar head and extending outward from the first planar surface. The boss forms a first plurality of bearing surfaces to interlock the planar head into the concrete panel, thereby increasing the strength of the interface between the erection anchor and the concrete panel.

In one aspect of this invention, the erection anchor has a second boss extending outward from the second planar surface along a length of the first lateral edge, and the first and second bosses form a second plurality of bearing surfaces that further interlock the planar head into the concrete panel. In another aspect of this invention, third and fourth bosses extend outward from the first and second planar surfaces, respectively, along a length of the second lateral edge. The third and fourth bosses form, respectively, third and fourth pluralities of bearing surfaces. The addition of more bosses on the planar head provides additional interlocking capability between the planar head and the concrete panel and, further increases the strength of the interface between the erection anchor and the concrete panel.

In another embodiment, the invention provides for an erection anchor to be used in a concrete panel that is lifted by a lifting device having a shackle. The erection anchor is formed by a forged unitary body having a substantially cylindrical shank with one end embedable in the end of the concrete panel and an opposite end extending into the recess in the end of the concrete panel. The forged unitary body further has a substantially cylindrical foot integrally formed with the one end of the shank and a shackle-engageable, planar head integrally formed with the opposite end of the shank. The planar head has an outer end with a cutout shaped to receive an end of the shackle and hold the shackle therein during a process of using the shackle to lift the concrete panel. Thus, the shackle does not contact the end of the concrete panel during the lifting process.

These and other objects and advantages of the present invention will become more readily apparent during the following detailed description taken in conjunction with the drawings herein.

BRIEF DESCRIPTION OF THE INVENTION

DETAILED DESCRIPTION OF THE INVENTION

Figure 1:
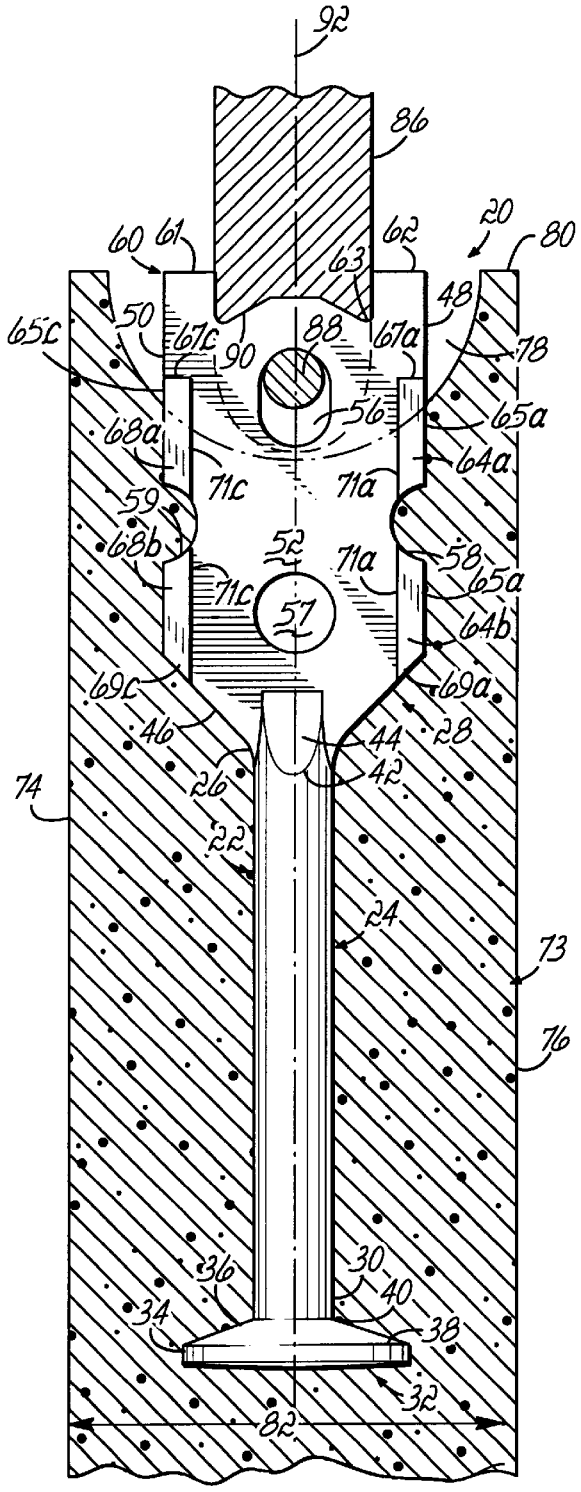
FIG. 1 is a plan view of an erection anchor shown in a concrete panel in accordance with the principles of the present invention.
Figure 2:
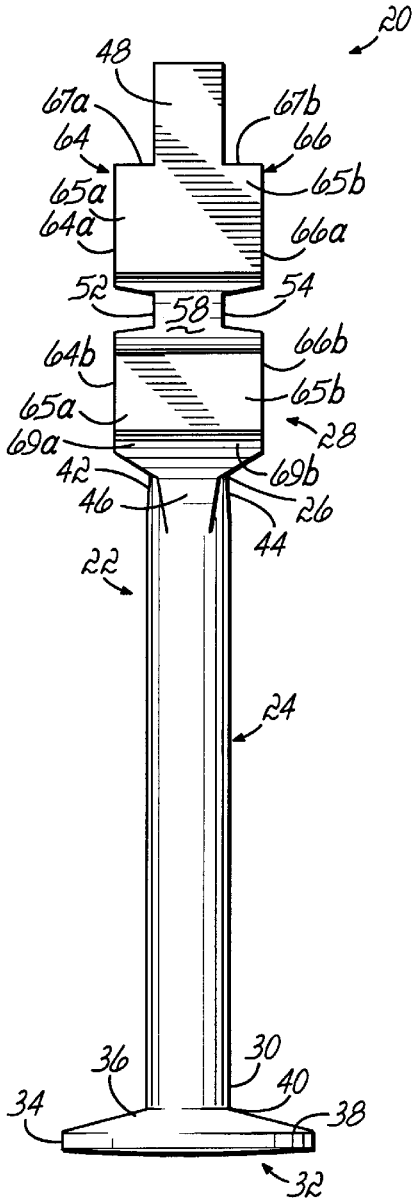
FIG. 2 is a plan view of one side of the erection anchor of FIG. 1.
Figure 3:
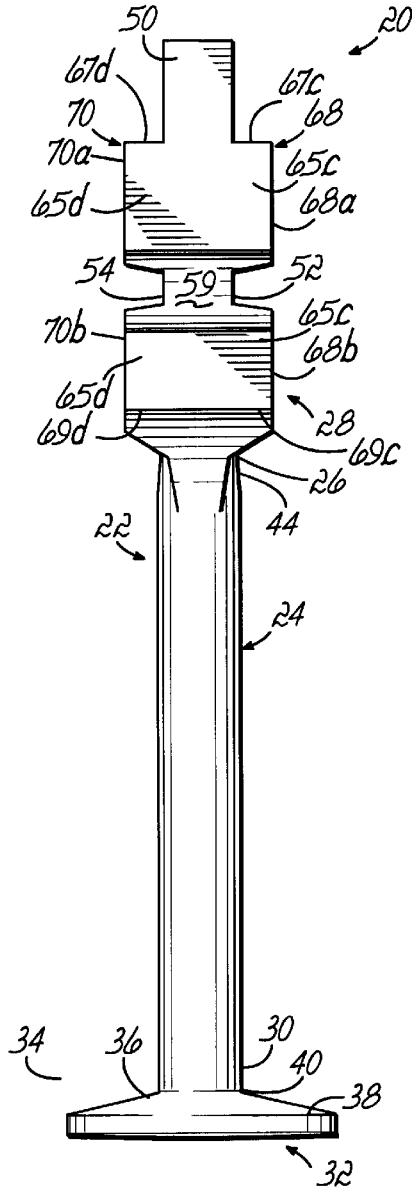
FIG. 3 is a plan view of an opposite side of the erection anchor of FIG. 1.
Figure 4:
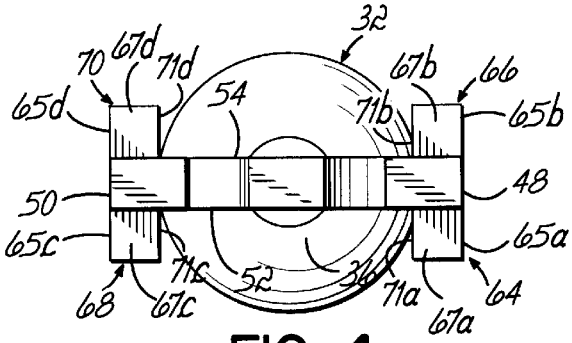
FIG. 4 is a top end view of the erection anchor of FIG. 1.

Referring to FIGS. 1–4, an erection anchor 20 is comprised of a body 22 having a cylindrical shank 24 with one end 26 connected to and integrally formed with a shackle-engageable, planar head 28. An opposite end 30 of the shank 24 is rigidly connected to and integrally formed with a generally circular foot 32. The foot 32 has an outer cylindrical portion 34 that is connected to the opposite end 30 of the shank 24 by a foot transition 36. The foot cylindrical portion 34 has a diameter that is larger than the diameter of the shank 24. The foot transition 36 intersects with the cylindrical portion 34 along a circular outer edge 38. The foot transition 36 intersects with the shank opposite end 30 along a substantially circular inner edge 40.

The planar head 28 is connected to the one end 26 of the shank 24 by a head transition 42. The head transition 42 has a configuration that minimizes abrupt changes in cross-sectional area in moving from the shank 24 to the head 28. Thus, the head transition 42 has a tapered portion 44 that smoothly blends the diameter of the shank 24 into closely spaced planar surfaces 52, 54 of the head 28. Further, the head transition 42 includes a flared portion 46 that smoothly blends the diameter of the shank 24 into a larger width of the planar head 28 defined by its lateral edges 48, 50. The opposed substantially parallel planar surfaces 52, 54 are separated by a thickness of the head 28 and extend between the lateral edges 48, 50. A first, shackle engaging hole 56 and a second hole 57 are disposed in the head 28. The second hole 57 may receive a metal reinforcing rod ("rebar") or may be filled with concrete to further stabilize and interlock the erection anchor 20 in a concrete panel 73. Opposed curvilinear, generally semicircular, recesses 58, 59 are located on the respective lateral edges 48, 50 of the head 28. The recesses 58, 59 are sized to receive rebar, if desired. The head 28 further has a cutout or notch 63 in an outer end 60. The notch 63 has sidewalls formed by two projections or ears 61, 62 that extend outward from the outer end 60 in line with the respective lateral edges 48, 50.

An interlocking first projection or boss 64 extends substantially perpendicularly outward from the planar surface 52 adjacent the first lateral edge 48 and provides an outer bearing surface 65*a*, upper and lower end bearing surfaces 67*a*, 69*a*, respectively, and an inner bearing surface 71*a*. The bearing surfaces 65*a*, 67*a*, 69*a*, 71*a*, are substantially perpendicular to the planar surface 52. An interlocking second boss 66 extends substantially perpendicularly outward from the parallel surface 54 adjacent the first lateral edge 48 and provides an outer bearing surface 65*b*, upper and lower end bearing surfaces 67*b*, 69*b*, respectively, and an inner bearing surface 71*b*. The bearing surfaces 65*b*, 67*b*, 69*b*, 71*b*, are substantially perpendicular to the planar surface 54 and are substantially parallel to the bearing surfaces 65*a*, 67*a*, 69*a*, 71*a*. The first and second bosses 64, 66 extend over a substantial length of the lateral edge 48; but the recess 58 splits each of the first and second bosses 64, 66 into two parts 64*a*, 64*b* and 66*a*, 66*b*, respectively.

An interlocking third projection or boss 68 extends substantially perpendicularly outward from the planar surface 52 adjacent the first lateral edge 50 and provides an outer bearing surface 65*c*, upper and lower end bearing surfaces 67*c*, 69*c*, respectively, and an inner bearing surface 71*c*. The bearing surfaces 65*c*, 67*c*, 69*c*, 71*c*, are substantially perpendicular to the planar surface 52 and are substantially parallel to the other respective bearing surfaces 65, 67, 69, 71. An interlocking fourth boss 70 extends substantially perpendicularly outward from the parallel surface 54 adjacent the first lateral edge 50 and provides an outer bearing surface 65*d*, upper and lower end bearing surfaces 67*d*, 69*d*, respectively, and an inner bearing surface 71*d*. The bearing surfaces 65*d*, 67*d*, 69*d*, 71*d*, are substantially perpendicular to the planar surface 54 and are substantially parallel to the other respective bearing surfaces 65, 67, 69, 71. The third and fourth second bosses 68, 70 extend over a substantial length of the lateral edge 50; but the recess 59 splits each of the third and fourth bosses 68, 70 into two parts 68*a*, 68*b* and 70*a*, 70*b*, respectively.

The erection anchor 20 is drop forged from a piece of carbon steel bar stock, for example, grade 65. Thus, the head 28 and bosses 64–70, foot 32 and connecting shank 24 form a single integral unit or body 22 of the erection anchor 20. As will be appreciated, depending on the application and designed load carrying capability, the erection anchor 20 may vary in length and may be manufactured from bar stock having different nominal sizes.

In use, the erection anchor 20 is molded into a concrete panel 73 having substantially parallel opposed surfaces 74, 76. A void 78 is formed in an end surface 80 of the concrete panel 73 in a known manner, and the generally spherically shaped void 78 contains the outer most portion of the erection anchor head 28. The concrete panel 73 has a thickness 82 in the range of 4–12 inches and thus, is relatively thin compared to its width and length. The concrete panel 73 is often fabricated in a generally horizontal position either on a construction site or at a remote location and then subsequently raised into a vertical position to form a wall of a structure.

Prior to molding the concrete panel 73, numerous erection anchors identical to the erection anchor 20 are supported and oriented in a substantially horizontal position in a known manner over a length of a concrete form (not shown). The following discussion with respect to the erection anchor 20 applies to each of the erection anchors used in the construction of the concrete panel 73. The erection anchor 20 must be oriented such that the parallel surfaces 52, 54 are substantially perpendicular to respective major surfaces 74, 76 of the concrete panel 73 to be manufactured. Thus, the bearing surfaces 65 are substantially parallel to the panel major surfaces 74, 76; and the bearing surfaces 67 are substantially perpendicular to the panel major surfaces 74, 76. Rebar (not shown) is also supported in the concrete form in a known manner and routed adjacent the erection anchor 20 through the hole 57 and recesses 58, 59, as desired.

A void mold (not shown) is mounted on an outer end of the head 28 and is used to form the cavity or void 78 in the end 80 of the concrete panel 73. Thereafter, concrete is poured into the concrete form in order to produce the concrete panel 73 and void 78 with the erection anchor 20 disposed therein. After the concrete sets, the void mold is removed; and the erection anchor outer end 60 and the hole 56 of the head 28 are located in the void 78.

Subsequently, a shackle 86 and lifting pin 88 are attached to the head 28 of the erection anchor 20. The lifting pin 88 passes through the shackle hole 56, and the notch 63 is configured or shaped to receive the end 90 of the shackle 86. The concrete panel 73 is normally cast in a horizontal orientation, that is, the major surfaces 74, 76 are generally horizontal. Therefore, to lift the concrete panel 73, a lifting force is applied in a generally vertically upward direction, that is, to the right as viewed in FIG. 1. When the lifting force is applied, the shackle 86 applies a significant force against the ear 62. Further, the lifting force may bend or deform the ear 62 and allow the shackle 86 to pivot with respect to the notch 63; but the end 90 of the shackle remains in the notch 63. Thus, the shackle 86 does not contact the end 80 of the concrete panel 73 during the process of lifting the concrete panel 73 from a generally horizontal to a generally vertical orientation.

Further, as the lifting force is applied to the shackle 86, the concrete panel 73 is pivoted in a generally clockwise direction as viewed in FIG. 1 with respect to an opposite end (not shown) of the concrete panel 73. As lifting forces are applied to the head 28 of the erection anchor 20, those forces must be reacted by the concrete panel 73. In that regard, the bosses and bearing surfaces 64–71 help to mechanically interlock the planar head 28 with the concrete panel 73. In this example, the bearing surfaces 65, 67 on bosses 64, 66 present a substantially larger area of contact between the erection anchor 20 and the concrete panel 73 than would the erection anchor 20 without the bosses 64, 66. That larger area of contact between the erection anchor 20 and the concrete panel 73 greatly increases the area over which the lifting forces can be reacted by the concrete panel 73, thereby increasing the capability of the concrete panel 73 to consistently and reliably react those lifting forces.

Thus, the erection anchor 20 having the integrally formed and unitary bosses 64–70 provides several advantages over known erection anchors fabricated from multiple parts. First, the erection anchor 20 with the integrally formed bosses and bearing surfaces 64–71 is drop forged from a single piece of bar stock. No fabrication is required, and an erection anchor 20 with the integrally formed bosses and bearing surfaces 64–71 can be manufactured at a cost that is substantially the same as anchors without the bosses and bearing surfaces 64–71. Thus, the erection anchor 20 is substantially less expensive than known erection anchors.

Second, the erection anchor 20 provides bosses 64, 66, 68, 70 along both lateral edges 48, 50 of the anchor head 28. Therefore, the erection anchor 20 can be located in multiple orientations within the concrete form, and further, the erection anchor 20 can support lifting forces in two directions; and thus, the concrete panel 73 can be lifted either clockwise or counterclockwise as desired.

Third, the outer end 60 of the anchor head 28 is configured to receive and hold the shackle end 90. Further, the ears 61, 62 also bear the lifting force, and prevent the shackle 86 from contacting the concrete panel end 80 as the concrete panel 73 is lifted to its desired vertical orientation.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, bosses 64, 66, 68, 70 are described and illustrated. As will be appreciated, in alternative embodiments, bosses on only one of the lateral edges may be used, for example, only bosses 64, 66 or only bosses 68, 70. In a further alternative embodiment, bosses on only one planar surface may be used, for example, only boss 64 or only boss 66, etc. In a still further embodiment, the bosses may be used on different lateral edges and/or different planar surfaces, for example, only bosses 64, 68, or only bosses 64, 70, etc. Thus any combination of integrally formed bosses may be used.

As will further be appreciated, in alternative embodiments, the planar head 28 can be made such that the planar surfaces 52, 54 are substantially planar but not flat over the entire surface. In another embodiment, one or more of the bosses 64, 66, 68, 70 can be offset from, that is, displaced inward from, either or both of the lateral edges 48, 50. In a further embodiment, one or more of the bearing surfaces 65, 67, 69, 71 can extend upward from a respective planar surface in a nonperpendicular direction. Thus, in such various embodiments, the bosses 64, 66, 68, 70 do not have to have a particular or precise position or orientation with respect to the lateral edges 48, 50 or the planar surfaces 52, 54. Further, the bearing surfaces 65, 67, 69 , 71 do not have to have a precise position or orientation with respect to the lateral edges 48, 50, the planar surfaces 52, 54 or the major surfaces 74 76 of the concrete panel 73. As shown by the outer bearing surfaces 65 being cut into two parts by the recesses 58, 59, the bearing surfaces 65, 67, 69, 71 can be either continuous or discontinuous surfaces or segments.

In still further embodiments, the diameter and length of the shank 24, the length, width and thickness of the head 28 as well as the size and shape of the foot 32 may be varied depending on the designed load requirements of a particular application.

Therefore, the invention in its broadest aspects is not limited to the specific details shown and described. Consequently, departures may be made from the details described herein without departing from the spirit and scope of the claims which follow.

What is claimed is:

1. An erection anchor for use in a concrete panel having substantially parallel major surfaces and a recess in an end of the concrete panel, the erection anchor comprising:

a forged unitary body comprising
- a substantially cylindrical shank with
  - one end adapted to be embedable in the end of the concrete panel, and
  - an opposite end adapted to extend into the recess in the end of the concrete panel;
- a substantially cylindrical foot integrally formed with the one end of the shank and adapted to be embedable in the concrete panel, the foot having a diameter greater than a diameter of the cylindrical shaft;
- a shackle-engageable, planar head integrally formed with the opposite end of the shank and adapted to be disposed in the recess in the end of the concrete panel, the planar head having first and second opposed substantially planar surfaces; and a first boss integrally formed with the planar head and extending outward from the first planar surface, the first boss forming a first plurality of bearing surfaces adapted to interlock the erection anchor with the concrete panel.

2. The erection anchor of claim 1 wherein the planar head further comprises lateral edges bounding the planar surfaces and the first boss extends substantially parallel to a first lateral edge of the first planar surface.

3. The erection anchor of claim 2 further comprising a second boss extending outward from, and integrally formed with, one of the first and second planar surfaces and substantially parallel to a second lateral edge, the second boss forming a second plurality of bearing surfaces adapted to interlock the erection anchor with the concrete panel.

4. The erection anchor of claim 3 further comprising a third boss extending outward from, and integrally formed with, another of the first and second planar surfaces and substantially parallel to the second lateral edge, the third boss forming a third plurality of bearing surfaces adapted to interlock the erection anchor with the concrete panel.

5. The erection anchor of claim 4 further comprising a fourth boss extending outward from, and integrally formed with, the second planar surface, the fourth boss being substantially parallel to the first lateral edge and forming a fourth plurality of bearing surfaces adapted to interlock the erection anchor with the concrete panel.

6. The erection anchor of claim 5 wherein all of the bearing surfaces are substantially perpendicular to one of the first and second planar surfaces.

7. The erection anchor of claim 6 wherein all of the bearing surfaces are substantially parallel.

8. The erection anchor of claim 5 wherein the first planar surface is substantially parallel to the second planar surface and all of the bearing surfaces are substantially perpendicular to the first and second planar surfaces.

9. The erection anchor of claim 1 wherein the concrete panel is lifted by a lifting device having a shackle, and the planar head further comprises an outer end with a cutout having a configuration adapted to receive an end of the shackle and hold the shackle therein during a process of lifting the concrete panel, thereby preventing the shackle from contacting the concrete panel.

10. The erection anchor of claim 9 wherein the outer end comprises opposed ears adapted to receive an end of the shackle therebetween, the opposed ears minimizing a pivoting of the shackle during a process of lifting the concrete panel, thereby preventing the shackle from contacting the concrete panel.

11. An erection anchor for use in a concrete panel having substantially parallel major surfaces and a recess in an end of the concrete panel, the erection anchor comprising:

a forged unitary body comprising a substantially cylindrical shank with one end adapted to be embedable in the end of the concrete panel, and an opposite end adapted to extend into the recess in the end of the concrete panel;

a substantially cylindrical foot integrally formed with the one end of the shank and adapted to be embedable in the concrete panel, the foot having a diameter greater than a diameter of the cylindrical shaft;

a shackle-engageable, planar head integrally formed with the opposite end of the shank and adapted to be disposed in the recess in the end of the concrete panel, the planar head having first and second substantially parallel planar surfaces extending between first and second lateral edges of the planar head;

first and second bosses integrally formed with the planar head and extending outward from, and substantially perpendicular to, the first and second planar surfaces, respectively, the first and second bosses having lengths substantially parallel to the first lateral edge and the first and second bosses forming respective first and second pluralities of bearing surfaces adapted to interlock the erection anchor with the concrete panel; and third and fourth bosses integrally formed with the planar head and extending outward from, and substantially perpendicular to, the first and second planar surfaces, respectively, the first and second bosses having lengths substantially parallel to the second lateral edge and the third and fourth bosses forming respective third and fourth pluralities of bearing surfaces adapted to interlock the erection anchor with the concrete panel.

12. The erection anchor of claim 11 wherein the concrete panel is lifted by a lifting device having a shackle, and the planar head further comprises an outer end with opposed ears adapted to receive an end of the shackle therebetween, the opposed ears minimizing a pivoting of the shackle during a process of lifting the concrete panel, thereby preventing the shackle from contacting the concrete panel.

13. A structural member comprising:

a concrete panel comprising two opposing major surfaces extending over a length and width of the concrete panel, an end surface extending between the opposing major surfaces and defining an end of the concrete panel, a recess disposed in the end surface; and an erection anchor comprising a forged unitary body comprising a substantially cylindrical shank with one end embedded in the end of the concrete panel, and an opposite end extending into the recess in the end of the concrete panel;

a substantially cylindrical foot integrally formed with the one end of the shank and embedded in the end of the concrete panel, the foot having a diameter greater than a diameter of the cylindrical shaft;

a shackle-engageable, planar head integrally formed with the opposite end of the shank and disposed in the recess in the end of the concrete panel, the planar head having first and second opposed planar surfaces; and a boss integrally formed with the planar head and extending outward from the first planar surface, the first boss forming a first plurality of bearing surfaces adapted to interlock the erection anchor with the concrete panel.

14. The erection anchor of claim 13 further comprising a plurality of bosses, each of the plurality of bosses extending outward from, and integrally formed with, one of the first and second planar surfaces and substantially parallel to one of the first and second lateral edges, and each of the plurality of bosses forming a plurality of bearing surfaces adapted to interlock the erection anchor with the concrete panel.

15. The erection anchor of claim 14 wherein the outer end comprises opposed ears adapted to receive an end of the shackle therebetween, the opposed ears minimizing a pivoting of the shackle during a process of lifting the concrete panel, thereby preventing the shackle from contacting the concrete panel.

16. A structural member comprising:

a concrete panel comprising two opposing major surfaces extending over a length and width of the concrete panel, an end surface extending between the opposing major surfaces and defining an end of the concrete panel, a recess disposed in the end surface; and an erection anchor comprising a forged unitary body comprising a substantially cylindrical shank with one end embedded in the end of the concrete panel, and an opposite end extending into the recess in the end of the concrete panel;

a substantially cylindrical foot integrally formed with the one end of the shank and embedded in the end of the concrete panel, the foot having a diameter greater than a diameter of the cylindrical shaft;

a shackle-engageable, planar head integrally formed with the opposite end of the shank and disposed in the recess in the end of the concrete panel, the planar head having first and second opposed planar surfaces; and first and second bosses integrally formed with the planar head and extending outward from, and substantially perpendicular to, the first and second planar surfaces, respectively, the first and second bosses having lengths substantially parallel to the first lateral edge and the first and second bosses forming respective first and second pluralities of bearing surfaces adapted to interlock the erection anchor with the concrete panel; and third and fourth bosses integrally formed with the planar head and extending outward from, and substantially perpendicular to, the first and second planar surfaces, respectively, the first and second bosses having lengths substantially parallel to the second lateral edge and the third and fourth bosses forming respective third and fourth pluralities of bearing surfaces adapted to interlock the erection anchor with the concrete panel.

17. The erection anchor of claim 16 wherein the concrete panel is lifted by a lifting device having a shackle, and the planar head further comprises an outer end with a cutout having a configuration adapted to receive an end of the shackle and hold the shackle therein during a process of lifting the concrete panel, thereby preventing the shackle from contacting the concrete panel.

18. The erection anchor of claim 16 wherein the outer end comprises opposed ears adapted to receive an end of the shackle therebetween, the opposed ears minimizing a pivoting of the shackle during a process of lifting the concrete panel, thereby preventing the shackle from contacting the concrete panel.

19. An erection anchor for use in a concrete panel having substantially parallel major surfaces and a recess in an end of the concrete panel, the concrete panel being lifted by a lifting device having a shackle, the erection anchor comprising:

a forged unitary body comprising a substantially cylindrical shank with one end adapted to be embedable in the end of the concrete panel, and an opposite end adapted to extend into the recess in the end of the concrete panel;

a substantially cylindrical foot integrally formed with the one end of the shank and adapted to be embedable in the concrete panel, the foot having a diameter greater than a diameter of the cylindrical shaft;

a shackle-engageable, planar head integrally formed with the opposite end of the shank, the planar head comprising boss integrally formed with the planar head and extending outward from a major surface of the planar head, the boss forming a first plurality of bearing surfaces adapted to interlock the erection anchor with the concrete panel, and an outer end with a pair of projections, each projection extending from the outer end of the planar head adjacent a different one of the lateral edges, the pair of projections forming side walls of a cutout having a configuration adapted to receive an end of the shackle and hold the shackle therein during a process of lifting the concrete panel.

* * * * *